US007409909B2

(12) United States Patent
Plaβwich et al.

(10) Patent No.: US 7,409,909 B2
(45) Date of Patent: Aug. 12, 2008

(54) METHOD FOR REPLACING PRINTING SLEEVES IN A PRINTING PRESS

(75) Inventors: Franz Plaβwich, Bremen (DE); Frank Twiehaus, Westerkappein (DE)

(73) Assignee: Windmoeller & Hoelscher KG, Lengerich (DE)

( * ) Notice: Subject to any disclaimer, the term of this patent is extended or adjusted under 35 U.S.C. 154(b) by 381 days.

(21) Appl. No.: 10/545,227

(22) PCT Filed: Jan. 14, 2004

(86) PCT No.: PCT/EP2004/000411

§ 371 (c)(1),
(2), (4) Date: Aug. 12, 2005

(87) PCT Pub. No.: WO2004/071768

PCT Pub. Date: Aug. 26, 2004

(65) Prior Publication Data

US 2006/0162600 A1 Jul. 27, 2006

(30) Foreign Application Priority Data

Feb. 12, 2003 (DE) ..... 103 05 956

(51) Int. Cl.
*B41F 1/34* (2006.01)
*B41L 3/02* (2006.01)

(52) U.S. Cl. ..... 101/485; 101/479; 101/486

(58) Field of Classification Search ..... 101/477, 101/216, 479

See application file for complete search history.

(56) References Cited

U.S. PATENT DOCUMENTS 6,038,972 A 3/2000 Delwiche et al.
6,792,857 B2 9/2004 Sameit et al.
2002/0129720 A1 * 9/2002 Jendroska et al. ..... 101/216

FOREIGN PATENT DOCUMENTS

DE 102 23 414 A1 1/2004
EP 0 400 517 B1 12/1990

OTHER PUBLICATIONS

Teichman, "Aktuelle Entwicklungen der Sleeve-Technologie im Flexo", Sleeve Technologie, (XP000958928), Nov. 4, 1999, pp. W12-W13 (No English Translation Available).

* cited by examiner

*Primary Examiner*—Daniel J. Colilla
*Assistant Examiner*—M. Ferguson-Samreth
(74) *Attorney, Agent, or Firm*—Jacobson Holman PLLC

(57) ABSTRACT

A process for replacing the printing sleeves of a printing machine includes mounting printing sleeves that are not required for the printing process in at least one storage device. The transportation of the printing sleeves necessary for replacement between the storage device and the printing machine is performed by a transportation device. The transportation device has printing sleeve retaining devices that bring the printing sleeves into a position that facilitates their replacement. The arrangement of the printing sleeves in the transportation device is determined by a processing and control unit to which set positions of the printing sleeves during the next printing job are known. The processing and control unit adjusts the arrangement of the printing sleeves such that at least one printing sleeve retaining device remains free in the transportation device.

14 Claims, 1 Drawing Sheet

METHOD FOR REPLACING PRINTING SLEEVES IN A PRINTING PRESS

This is a nationalization of PCT/EP04/000411 filed 14 Jan. 2004 and published in German.

BACKGROUND OF THE INVENTION

1. Field of Invention

The invention relates to a process for replacing printing sleeves in a printing machine in which printing sleeves that are not required for the printing process are mounted in at least one storage device. The transportation of the printing sleeves necessary for replacement between the storage device and the printing machine is performed by at least one transportation device that has printing sleeve retaining devices which bring the printing sleeves into a position that facilitates their replacement.

2. Description of the Prior Art

The invention relates to a process for replacing printing sleeves in a printing machine according to the generic term of claim 1.

For the processing of printing jobs it is frequently necessary to replace the printing motifs of the print rollers of a printing machine. For the purpose of being able to execute this job changeover as quickly and easily as possible, frequently only the printing sleeves carrying the printing motifs and lying on the roller mandrels are replaced.

The unpublished patent application DE 102 23 414 suggests a transportation device for printing sleeves with several carrying mandrels for accommodating the printing sleeves. Every two adjoining carrying mandrels have a distance between them that corresponds to the distance of the print roller and the anilox roller in their set-up positions. Both these carrying mandrels form one row inside the transportation device. The transportation device can be coupled to a lifting device by means of which it can move horizontally and vertically with respect to the printing machine.

If a printing sleeve is supposed to be replaced, the operating personnel must first equip the transportation device with the printing sleeves to be inserted into the printing machine. The operating personnel also has to position the transport device with the help of the lifting device in front of the printing unit in which the printing sleeves to be replaced are located, so that two free carrying mandrels are positioned in front of the print rollers. Then the printing sleeves located on the print roller mandrels can be pulled out by the operating personnel. Subsequently, the transportation device is placed in a new position in order to bring the printing sleeves into a suitable position for fitting them on the roller mandrels. Then the printing sleeves can be fitted. If necessary, the process is carried out similarly for additional printing units.

In the described process for the replacement of printing sleeves of a printing machine, the operating personnel equips the transportation device without observing any predetermined arrangement of the printing sleeves. Thus the operating personnel must independently plan the arrangement of the printing sleeves in the transportation device. This arrangement is in part disadvantageous for the set-up process. Additionally, it also entails the risk of an erroneous allocation of the printing sleeves to the roller mandrels.

SUMMARY OF THE INVENTION

Therefore the task of the present invention is to suggest a process for replacing printing sleeves in printing machines that simplifies the process of replacement of printing sleeves.

According to the invention, this task is solved by the features of the invention as described herein.

According to one embodiment of the invention, the arrangement of the printing sleeves in the transportation device is determined by a processing and control unit. In doing so, the arrangement of the printing sleeves is adjusted in such a manner that at least one printing sleeve retaining device in the transportation device remains free. The processing and control unit takes into account all the relevant printing sleeves. Thus not only those that are supposed to be supplied to the printing machine are taken into account but also those that have to be led away from the printing machine and supplied to the storage device. As a basis for the determination of the arrangement of the printing sleeves, the processing and control unit uses data about the set positions of the individual printing sleeves for processing the new printing job as well as data about the actual positions of the printing sleeves in the printing machine. Even data about the positions of the printing sleeves in the storage device can be known to the processing and control unit.

Advantageously the process and control unit determines the arrangement of the printing sleeves in the transportation device in such a manner that every row contains at least one empty printing sleeve retaining device and at least one new printing sleeve required for the new printing job. Each row of the transportation device is thus assigned to a definite printing unit. Thus for each printing unit at least one empty printing sleeve retaining unit is provided. If for instance, the printing unit is arranged horizontally, the printing sleeve retaining devices can also be arranged horizontally. In this case, after a printing sleeve of a processed printing job is pushed off, only the transportation device must be displaced horizontally in order to reach a position in which a new printing sleeve can be fitted on the roller mandrel.

In another preferred embodiment of the invention, the processing and control unit determines the arrangement of the printing sleeves in the transportation device in such a manner that one row of printing sleeve retaining devices remains free and the other rows contain the printing sleeves assigned to the respective printing units. In this case thus firstly all printing sleeves of a printing unit are removed by the roller mandrels. Thereafter, the transportation device is displaced vertically so that the new printing sleeves assigned to the related printing unit can be brought into a position that is suitable for the replacement.

It is particularly advantageous if the arrangement of the printing sleeves in the transportation-device determined by the processing and control unit is indicated on a display unit. A monitor can be provided as a display unit. However, even other means for indicating the arrangement are suitable for this purpose, for instance, printouts from a printer.

In a preferred embodiment of the invention, the arrangement of the printing sleeves in the transportation device determined by the processing and control unit is executed by the operating personnel. For this purpose the operating personnel removes the corresponding printing sleeves from the storage device and arranges them in the transportation device according to the arrangement indicated on the display unit.

It is particularly advantageous if the processing and control unit has interfaces to actuators of the storage and/or transportation device and controls them in such a manner that they carry out the transfer, at least in part, between the two said devices. For this purpose, the processing and control unit has access to data that contains the positions of every individual printing sleeve in the storage device. In this manner the transportation device can be equipped with printing sleeves without permutation. The printing sleeves that are removed from the printing machine and transported in the transport device are supplied in the similar manner to the storage device, wherein the data containing the positions of the printing sleeves remain accessible for the processing and control unit. A data memory connected to the processing and control unit can be used for this purpose.

Furthermore, it is advantageous if the processing and control unit has interfaces to actuators of the transportation device and/or the printing machine and controls them in such a manner that they execute at least in part the transfer between the two said devices. A control of this type serves for the automatic transfer of the transportation device to the printing machine and back. Moreover, the control can comprise the coupling and decoupling of the transportation-device to and/or from a lifting device as well as the movement of the transportation device with respect to the printing machine.

In a preferred embodiment of the invention, the processing and control unit, on the basis of the arrangement of the printing sleeves in the transportation device determined by it, controls the position of the transportation device with respect to the printing machine in such a manner that empty printing sleeve retaining devices are brought into a removal position to the roller mandrels that are loaded with the printing sleeves to be replaced and subsequently the printing sleeve retaining devices loaded with the new printing sleeves are brought into the replacement position. In this course of action, the operating personnel can first remove a printing sleeve of the already processed printing job from the roller mandrel and fit it on an empty printing sleeve retaining device. If the operating personnel of the processing and control unit has indicated the completion of this activity, for instance, by means of a key press, then the processing and control unit controls the actuators in such a manner that the printing sleeve of the new printing job that is supposed to be fitted on the roller mandrel is brought into the replacement position. This process is carried out for all roller mandrels from which a printing sleeve is supposed to be removed and/or on which a printing sleeve is supposed to be fitted.

DETAILED DESCRIPTION OF THE PREFERRED EMBODIMENTS

Figure 1:
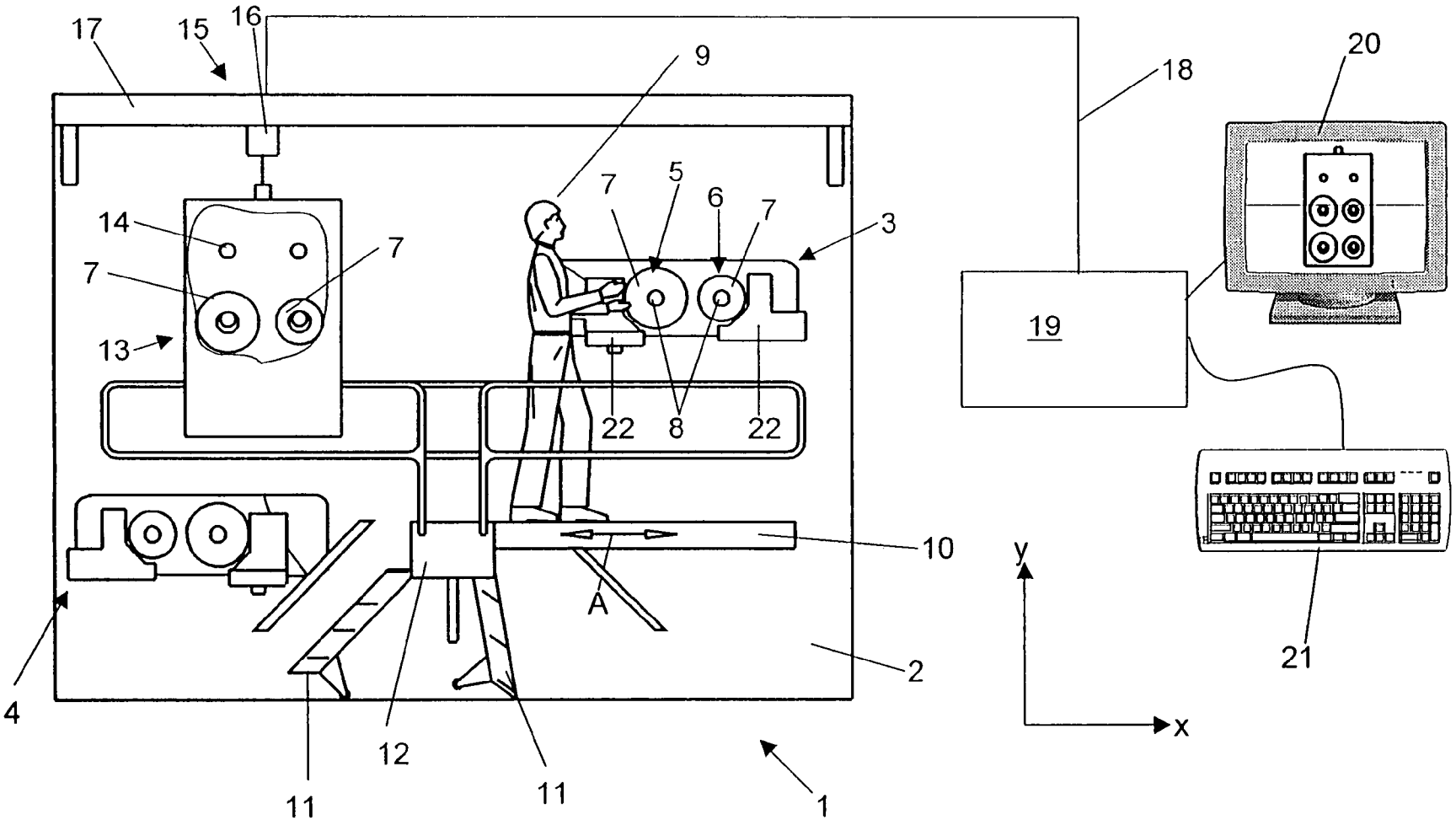
FIG. 1 illustrates a printing machine that is set up as per the process according to the invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The printing machine 1 comprises two side frames of which the front side frame 2 can be seen in the FIGURE. From the front side frame 2, several printing units are accessible of which two printing units 3, 4 are illustrated as an example. From the printing unit 3, both the bearing blocks 22 can be seen located in their distant positions so that the print roller 5 and the anilox roller 6 are accessible. The print roller 5 comprises substantially of the roller mandrel 8 and the printing sleeve 7 fitted on it. The anilox roller 6 is set up similarly.

In order to reach the lower printing units, of which only the printing unit 4 is illustrated, the footbridge 10 that is mounted in the pedestal 12 can be displaced along the arrow A. Moreover any of the two staircases 11 can be folded.

Furthermore, the printing machine comprises a lifting device 15 with which a transportation device 13 can move with respect to the printing machine 1. A horizontal movement is possible due to a slide rail 17 that is attached to the side frame 2. A rope winch 16 that is mounted displaceably on the slide rail 17, serves for lifting the transport device 13.

For setting up the printing machine 1 for a new printing job, the operating personnel can first give information about the new printing job to the processing and control unit 19 via a keyboard 21. Subsequently the processing and control unit computes the arrangement of the printing sleeves in the transportation device 13. Now the operating personnel 9 must equip the transportation device 13 in a manner that is not illustrated in closer detail according to the arrangement determined by the processing and control unit 19. For this purpose this arrangement is displayed on the monitor 20. Subsequently, the operating personnel 9 goes to the first printing unit 3 from which the printing sleeves 7 have to be removed. The processing and control unit 19 controls the lifting device 15 via the control line 18 in such a manner that a free carrying mandrel 14 of the transportation device 13 is brought into a position that makes it possible to pull out a printing sleeve 7 from the roller mandrel 8. After the displacement of the printing sleeve 7 from the roller mandrel 8 onto the carrying mandrel 14, the operating personnel 9 activates a pushbutton that is not illustrated in the FIGURE. The processing and control unit 19 now controls the lifting device 15 so that a carrying mandrel 14 on which a new printing sleeve 7 is present, takes up a replacement position. After the displacement of this printing sleeve 7, the operating personnel 9 reactivate the pushbutton that is not illustrated in the FIGURE.

The described course of action is carried out for all additional print and/or anilox rollers 5, 6 that have to be equipped for the new printing job.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

List of reference symbols

| | |
|---|---|
| 1 | Printing machine |
| 2 | Side frame |
| 3 | Printing unit |
| 4 | Printing unit |
| 5 | Print roller |
| 6 | Anilox roller |
| 7 | Printing sleeve |
| 8 | Roller mandrel |
| 9 | Operating personnel |
| 10 | Footbridge |
| 11 | Staircase |
| 12 | Pedestal |
| 13 | Transportation device (conveyor) |
| 14 | support mandrel |
| 15 | Lifting device |
| 16 | Rope winch |
| 17 | Slide rail |
| 18 | Control line |
| 19 | Processing and control unit |
| 20 | Monitor |
| 21 | Keyboard |

-continued

| List of reference symbols | |
|---|---|
| 22 | Bearing block |
| 23 | |
| 24 | |
| A | displacement direction of the footbridge 10 |
| x, y | Moving directions of the lifting device 15 |

What is claimed is:

1. A process for changing printing sleeves of a printing machine, comprising:

mounting the printing sleeves that are not required for a printing process in at least one storage device;

transporting the printing sleeves necessary for replacement between the storage device and the printing machine with at least one transportation device having printing sleeve retaining devices that bring the printing sleeves into a position for replacement;

determining an arrangement of the printing sleeves in the transportation device with a processing and control unit to which set positions of the printing sleeves in the printing machine during a next printing job are known;

adjusting with the processing and control unit the arrangement of the printing sleeves such that at least one printing sleeve retaining device remains free in the transportation device; and controlling with the processing and control unit, based on the determined arrangement of the printing sleeves in the transportation device, a position of printing sleeves accommodation devices in the transportation device such that (i) empty printing sleeve retaining devices are brought into a removal position to roller mandrels that are loaded with the printing sleeves to be replaced, and (ii) subsequently the printing sleeve retaining devices loaded with the new printing sleeves are brought into the replacement position.

2. The process according to claim 1 wherein the processing and control unit determines the arrangement of the printing sleeves in the transportation device such that every row of the transportation device contains at least one empty printing sleeve retaining device and at least one new printing sleeve required for the new printing job.

3. The process according to claim 1 wherein the processing and control unit determines the arrangement of the printing sleeves in the transportation device such that one row of the transportation device remains free of printing sleeve retaining devices and other rows contain the printing sleeves assigned to respective printing units.

4. The process according to claim 1 wherein the arrangement of the printing sleeves in the transportation device determined by the processing and control unit is indicated on a display unit.

5. The process according to claim 1 wherein the arrangement of the printing sleeves in the transportation device determined by the processing and control unit is carried out by operating personnel.

6. The process according to claim 1 wherein the processing and control unit interfaces with and controls the storage and/or transportation device.

7. The process according to claim 1 wherein the processing and control unit interfaces with and controls the storage and/or transportation device and/or the printing machine.

8. An apparatus for the replacement of printing sleeves in a printing machine comprising:

a storage device in which the printing sleeves that are not required for a printing process are mounted;

at least one transportation device that transports the printing sleeves necessary for replacement between the storage device and the printing machine, the transportation device including printing sleeve retaining devices that bring the printing sleeves into a position for replacement and the transportation device being configured to adjust an arrangement of the printing sleeves such that at least one printing sleeve retaining device remains free in the transportation device; and a processing and control unit that determines the arrangement of the printing sleeves in the transportation device and controls, based on the determined arrangement of the printing sleeves in the transportation device, a position of printing sleeves accommodation devices in the transportation device such that (i) empty printing sleeve retaining devices are brought into a removal position to roller mandrels that are loaded with the printing sleeves to be replaced, and (ii) the printing sleeve retaining devices loaded with the new printing sleeves are brought into the replacement position.

9. The apparatus according to claim 8 wherein the arrangement of the printing sleeves in the transportation device determined by the processing and control unit is indicated on a display unit.

10. The apparatus according to claim 8 wherein the processing and control unit determines the arrangement of the printing sleeves in the transportation device such that every row of the transportation device contains at least one empty printing sleeve retaining device and at least one new printing sleeve required for the new printing job.

11. The apparatus according to claim 8 wherein the processing and control unit determines the arrangement of the printing sleeves in the transportation device such that one row of the transportation device remains free of printing sleeve retaining devices and other rows contain the printing sleeves assigned to respective printing units.

12. The apparatus according to claim 8 wherein the arrangement of the printing sleeves in the transportation device determined by the processing and control unit is carried out by operating personnel.

13. The apparatus according to claim 8 wherein the processing and control unit interfaces with and controls the storage and/or transportation device.

14. The apparatus according to claim 8 wherein the processing and control unit interfaces with and controls the storage and/or transportation device and/or the printing machine.

* * * * *